US007284578B2

(12) United States Patent
Monti

(10) Patent No.: US 7,284,578 B2
(45) Date of Patent: Oct. 23, 2007

(54) APPARATUS FOR PLACING PRODUCTS INTO BLISTERS OF A BLISTER BAND

(75) Inventor: Guiseppe Monti, Pianoro (IT)

(73) Assignee: Marchesini Group S.p.A., Planoro (Bologna) (IT)

( * ) Notice: Subject to any disclaimer, the term of this patent is extended or adjusted under 35 U.S.C. 154(b) by 268 days.

(21) Appl. No.: 11/201,935

(22) Filed: Aug. 11, 2005

(65) Prior Publication Data

US 2006/0037664 A1 Feb. 23, 2006

(30) Foreign Application Priority Data

Aug. 20, 2004 (IT) ..... BO2004A0530

(51) Int. Cl.
*B65B 43/42* (2006.01)

(52) U.S. Cl. ..... 141/135; 141/131; 141/237; 141/284; 53/247; 53/250

(58) Field of Classification Search ..... 141/129, 141/131, 135, 234, 237, 283, 284; 53/245–247, 53/250

See application file for complete search history.

(56) References Cited

U.S. PATENT DOCUMENTS 4,834,264 A 5/1989 Siegel et al.
5,630,347 A * 5/1997 Elvio ..... 83/210
5,802,804 A * 9/1998 Esposti et al. ..... 53/55
6,311,743 B1 * 11/2001 Baroncini ..... 141/234
6,588,457 B2 * 7/2003 Fotland ..... 141/2
6,598,370 B2 * 7/2003 Baroncini ..... 53/235
7,128,100 B2 * 10/2006 Monti ..... 141/74
2002/0136619 A1 9/2002 Baroncini

FOREIGN PATENT DOCUMENTS

| | | |
|---|---|---|
| CH | 373689 | 11/1963 |
| DE | 3842273 | 6/1989 |
| GB | 1164761 | 9/1969 |
| GB | 1208674 | 10/1970 |

* cited by examiner

*Primary Examiner*—Timothy L. Maust
(74) *Attorney, Agent, or Firm*—William J. Sapone; Coleman Sudol Sapone P.C.

(57) ABSTRACT

In an apparatus for filling a blister band with products, two or more work units are carried by relative carriages and have hoppers fed with different kinds of products. The products are then supplied to discharge conduits leading to the blisters of the band. Strips are fastened to lower ends of the discharge conduits and match with the upper surface of the blister band. The carriages are operated in a to-and-fro motion, so as to center, the lower ends of the discharge conduits with respect to the blisters, and to maintain this centering for a prefixed time. The holes remain coaxial to the lower ends of the conduits, situated above, to allow passage of one product from each discharge conduit to a blister.

18 Claims, 7 Drawing Sheets

FIG.7
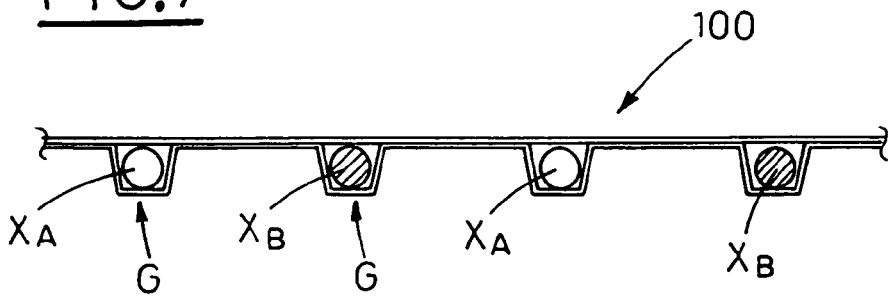
FIG.8A
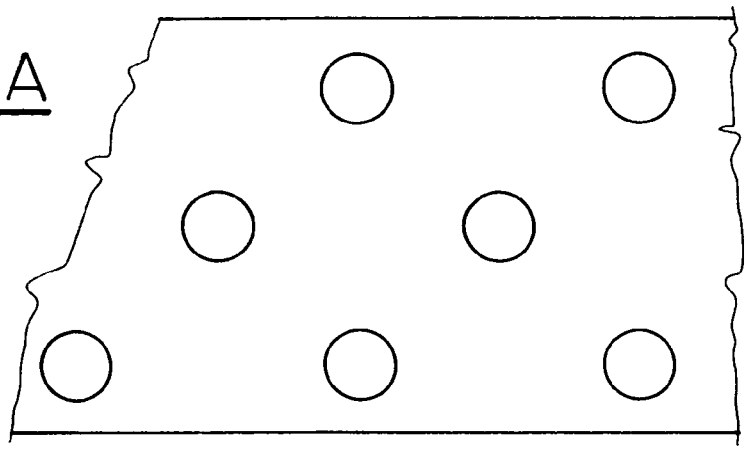
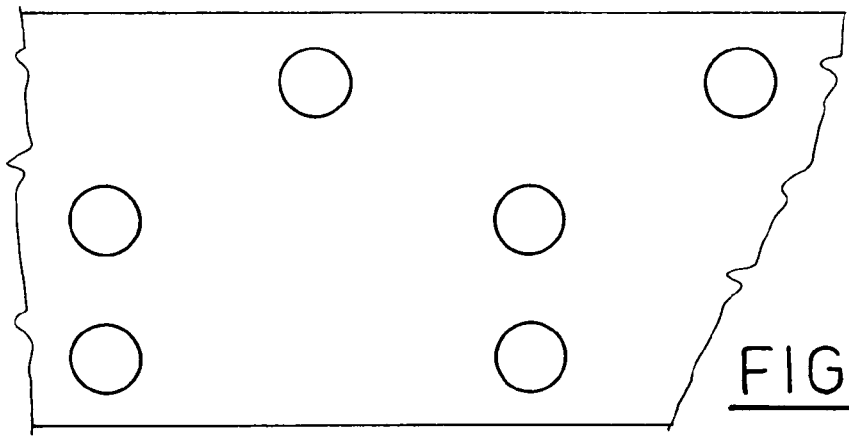
FIG.8B
FIG.9A
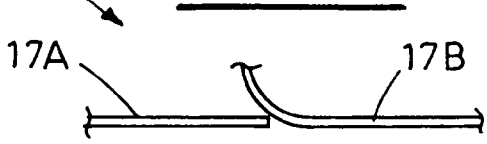
FIG.9B
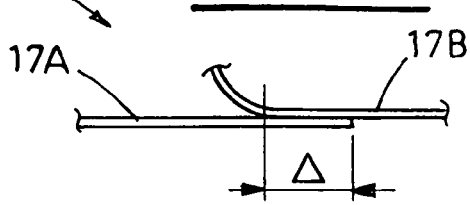

APPARATUS FOR PLACING PRODUCTS INTO BLISTERS OF A BLISTER BAND

BACKGROUND OF THE INVENTION

The present invention relates to an apparatus for placing products into blisters of a blister band.

The proposed invention relates to an apparatus used for feeding and distributing products, for example tablets, pills and the like, preferably in the pharmaceutical field, to a blister band of a blistering machine.

BRIEF DESCRIPTION OF THE PRIOR ART

There are apparatuses, which fill the blisters of a blister band using different techniques.

One of these apparatuses basically includes a bottomless box-like container, which is situated directly above the blister band and whose width does not exceed the width of the band.

The band is driven into forward translation with the blisters turned toward the container, so that they pass progressively and longitudinally beneath the container.

The container is filled by a feeding conduit, which conveys a number of products to be fed to the blister band, such that they accumulate on the band surface.

Distribution means, using brushes and the like, and other delivery means, distribute the accumulated products in such a way that they enter empty blisters and then they move together with the band until they leave the container.

The exceeding products are suitably maintained inside the container.

The above described system can be used with bands moved both in steps and continuously, and does not cause any problems concerning alignment of the products with respect to the corresponding blisters.

Another known apparatus includes a plurality of feeding conduits with the products piled up thereinside. Each conduit is situated so as to match one longitudinal row of blisters made in the band.

The lower end of the conduits skims the band surface and, due to the motion of the latter, the products fall, by gravity, into the respective blisters, when they pass below the conduit.

The known apparatuses are fed with products of the same type and are shaped in such a way as to fill all the blisters with products, which are equal.

Consequently, the blistering machines equipped with the apparatus of the described type, supply blister packs containing products of the same kind.

There is a need of supplying blister packs containing at least two kinds of products, with each product introduced in a relative blister.

For example, a blister pack, which has at least one transversal row of blisters containing a first type of products, and the remaining transversal rows of blisters contain a second type of products; the transversal rows containing the first type of products can be e.g. offset with respect to the rows of blisters containing the second type of products, or arranged in any way.

Otherwise, the blister pack can have blisters not necessarily arranged in transversal rows and the two types of products arranged in any way in the relative blisters.

The above described apparatuses have a remarkable drawback deriving from the fact that they do not allow a selective introduction of the products into the prefixed blisters of a blister band, since all the blisters are filled with the products of the same type, which undoubtedly creates a functioning limitation to the apparatus.

SUMMARY OF THE INVENTION

The object of the present invention is to propose an apparatus, which avoids the above mentioned drawback, because it is shaped in such a way, as to introduce selectively at least two types of products into prefixed blisters of a blister band, with each blister filled with only one product, all this independently from the distribution of the blisters in the blister band.

Another object of the present invention is to propose an apparatus, in which the introduction of the first type of products into the relative blisters does not influence the introduction of the second type of products into the corresponding blisters, and vice versa.

A further object of the present invention is to propose an apparatus, which not only obtains the previous objects, but is also defined by members and/or means simple to obtain and assemble, and which simplify its installation and maintenance.

The above mentioned objects are obtained, in accordance with the contents of the claims, by an apparatus for placing products into blisters of a blister band moved in a forward motion direction along a blistering machine, with blisters made in an upper surface of said blister band and made accessible from top, the apparatus having at least one work unit, situated above said blister band, the work unit including:

a carriage carried by a support, connected to a bearing structure of said blistering machine, with the carriage capable of sliding, with respect to the support, parallel to the blister band forward motion direction;

at least one hopper, carried by said carriage, fed with products and feeding said products to at least one discharge conduit fastened to said carriage, the discharge conduit having a lower end situated directly above the upper surface of said blister band and aligned with respect to a corresponding longitudinal row of blisters made in the latter;

first means for operating said carriage between two extreme positions, a rear position and a fore position, by a forward stroke and return stroke, with the forward stroke being operated in step relation with advancement of said blister band, so as to center the lower end of said discharge conduit with respect to a corresponding blister of said row, situated below and to maintain this centering for a prefixed period of time;

at least one moving assembly, connected to said carriage and carrying a strip interposed between said lower end of at least one discharge conduit and the upper surface of the blister band, and extending forward with respect to the band forward motion direction, said strip having at least one hole, which is aligned with the longitudinal row of blisters and whose size allows single products to pass therethrough;

second means for moving said strip parallel to the blister band forward motion direction, in step relation with the operation of said carriage, thus performing a forward stroke and a return stroke, between two extreme positions, a rest position and a working position, with the rest position preventing the lowermost product of the pile of products contained in said conduit from falling, and with the working position, defined by said forward stroke, allowing the centering of the hole with the lower end of said conduit, situated above, and consequently, allowing the said lowermost product to fall into said blister, during said time period.

BRIEF DESCRIPTION OF THE DRAWINGS

The characteristic features of the invention, as well as the operation of the technical solution claimed in the appended claims, will be pointed out in the following detailed description of a preferred embodiment, with reference to the enclosed figures, in which:

FIG. 7 is a lateral, schematic view of a blister pack, whose blisters have been filled by the proposed apparatus;

FIGS. 8*a*, 8*b* are top views of as many arrangements of the blisters of an blister band;

FIG. 9A shows the particular Q of FIG. 9;

FIG. 9B shows the same particular Q of FIG. 9 in a possible working situation.

DISCLOSURE OF THE PREFERRED EMBODIMENTS

Figure 1:
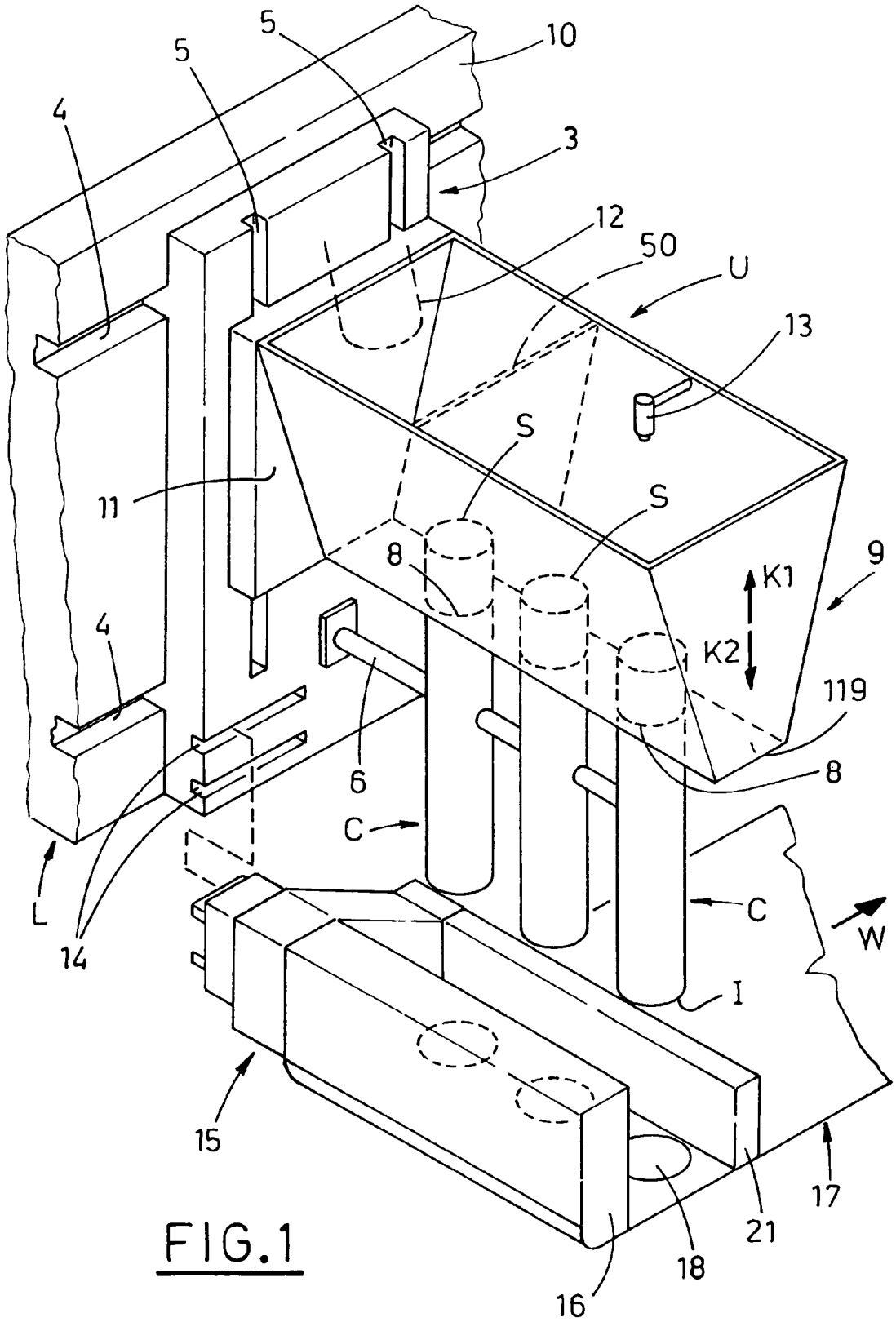
FIG. 1 is a perspective, schematic view of a work unit of the apparatus proposed by the present invention.

With regards to the above Figures, reference numeral 10 indicates a plate fastened to a bearing structure (not shown) of a blistering machine (also not shown), to which the apparatus proposed by the present invention is connected.

The plate is kept in a working position L (shown in Figures): for reasons explained later, the plate can be moved to in a raised position with respect to the working position.

N work units $U_A$, $U_B$, . . . $U_n$ are fastened to the plate 10 in a number corresponding to N types of products $X_A$, $X_B$, . . . $X_n$ to be introduced into corresponding blisters $Y_A$, $Y_B$, . . . $Y_n$ of a blister band 20.

FIGS. 2-6 take into consideration two work units $U_A$, $U_B$, which process relevant products $X_A$, $X_B$, to be introduced into corresponding blisters $Y_A$, $Y_B$; it is understood that all the considerations concerning the units $U_A$, $U_B$, can be extended to the apparatus with N work units.

FIG. 1 shows one of these units, indicated with U.

The following description will refer initially to the work unit U of FIG. 1, for the remaining units $U_A$, $U_B$, the same references will be used, with subscripts "A", "B".

With reference to FIG. 1, the unit U includes a slide 3, gliding on the longitudinal guides 4, made in the plate 10.

The slide 3 is operated by first known means, not shown, so as to move between extreme positions, rear $Z_1$ and forth $Z_2$, by a forward stroke $H_1$ and return stroke $H_2$.

The slide 3 supports, by known means 6, a series of discharging conduits C (for example vertical), whose lower ends 1 are situated directly above the upper surface 20A of the blister band 20 situated below and aligned with respect to the corresponding rows F of blisters $Y_A$, $Y_B$, made in the band.

The shown case relates to an example band having three longitudinal rows of blisters (see FIGS. 3A, 4A), with three corresponding conduits C, which in the shown case are aligned transversely, that is perpendicular to the band forward motion direction W.

The upper portions of the conduits C are freely introduced into relative holes 8 made in the bottom 119 of a hopper 9 carried by a carriage 11, which slides on vertical guides made in the slide 3, supporting the carriage.

A feeding conduit 12 supplies the hopper with products X; a sensor 13 detects the level R of the products in the hopper: the relative signal is processed, according to known techniques, by the central unit for the control of the products feeding, so as to assure the minimum level above the upper ends S of the conduits C.

Known means, not shown, operate the hopper 9 to move vertically with a vertical vibratory motion way (directions $K_1$, $K_2$) with such a stroke, as to keep the upper ends S of the conduits C dipped in the bulk of products present in the hopper.

Longitudinal guides 14 are made in the slide 3 for guiding a moving assembly 15, which carries an arm 16, perpendicular to the slide, as well as to the band forward motion direction W.

The moving assembly 15 is moved by second means, not shown, between two extreme positions, rest position $M_1$ and working position $M_2$, along the forward stroke $N_1$ and return stroke $N_2$.

An end of an extremely thin strip 17 (e.g. 0.07 mm), of steel, teflon or any other material, fastened to the arm 16, extends above the blister band 20 in the feeding direction W and matches the band upper surface 20A in working conditions of the work unit U.

It is to be pointed out that the strip is interposed between the surface 20A and the lower ends I of the conduits C.

Holes 18 (in the shown example three) are made in the strip and situated in such a way, as to be aligned with corresponding rows of blisters F.

The size of the holes allows single products, in the working situation explained later on, to pass through the holes.

The moving assembly 15 carries a second arm 21, parallel to the firs arm 16 and situated before it, with reference to the forward motion direction W of the band 20.

The second arm carries suction means, which are not shown in detail and whose function will be pointed out later on.

Now the operation of the proposed apparatus will be described.

Having regards to FIGS. 2-6, $T_1$-$T_6$ indicate fixed references aimed at pointing out the positions of the moving members (blister band 20, carriages 3A, 3B, moving assemblies 15A, 15B) in some significant moments relating to the introduction of the products $X_A$, $X_B$ into corresponding prefixed blisters $Y_A$, $Y_B$.

In the above Figures the plate 10 is in the working configuration L, the hoppers 9A, 9B of the first unit $U_A$ and the second unit $U_B$ contain the products $X_A$, $X_B$, of the first and second kind, respectively, which occupy the conduits 7A, 7B due to the vertical vibratory motion (directions $K_1$, $K_2$) of the hoppers.

Figure 2:
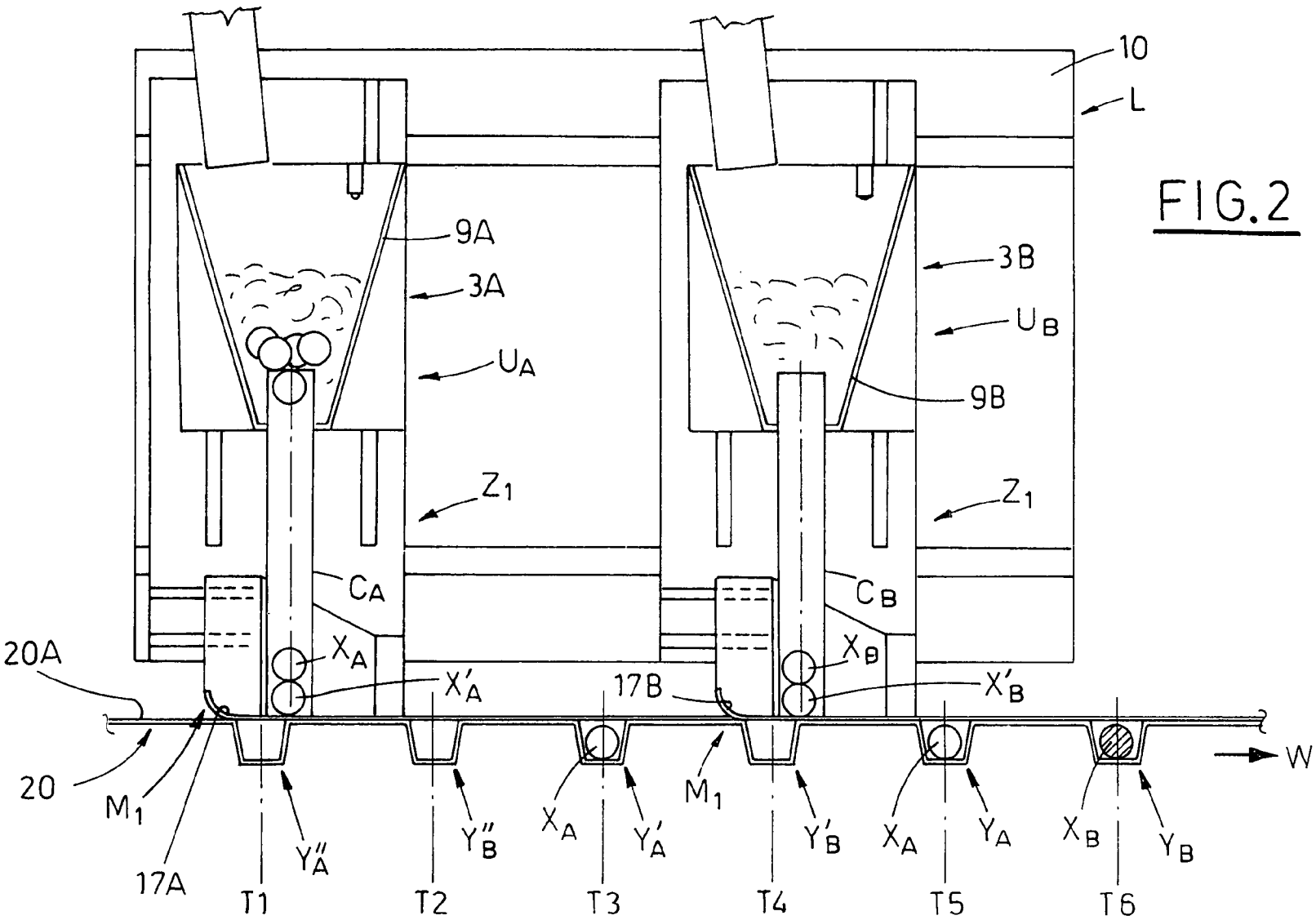
FIGS. 2 and 3 are lateral and schematic views of the proposed apparatus having two work units, in as many significant working configurations.

In FIG. 2 the slides 3A, 3B are in the rear position $Z_1$, and the moving assemblies 15A, 15B are in the rest position $M_1$.

It appears evident from FIG. 2 that the downstream end of the strip 17A of the first unit $U_A$ is practically laid on the initial part of the strip 17B of the second unit $U_B$.

$Y_A$, $Y'_A$, $Y''_A$ indicate the blisters of the blister band, which receive the products $X_A$ of the first kind, FIG. 2 shows the blisters $Y_A$, $Y'_A$ already filled with the products $X_A$.

$Y_B$, $Y'_B$, $Y''_B$ indicate the blisters of the blister band, which receive the products of the second kind, FIG. 2 shows the blister $Y_B$ already filled with the product $X_B$.

The configuration of FIG. 2 points out that the conduits $C_A$, $C_B$ of the units $U_A$, $U_B$ are slightly offset rearward with respect to the corresponding blisters $Y''_A$, $Y'_B$.

Figure 3:
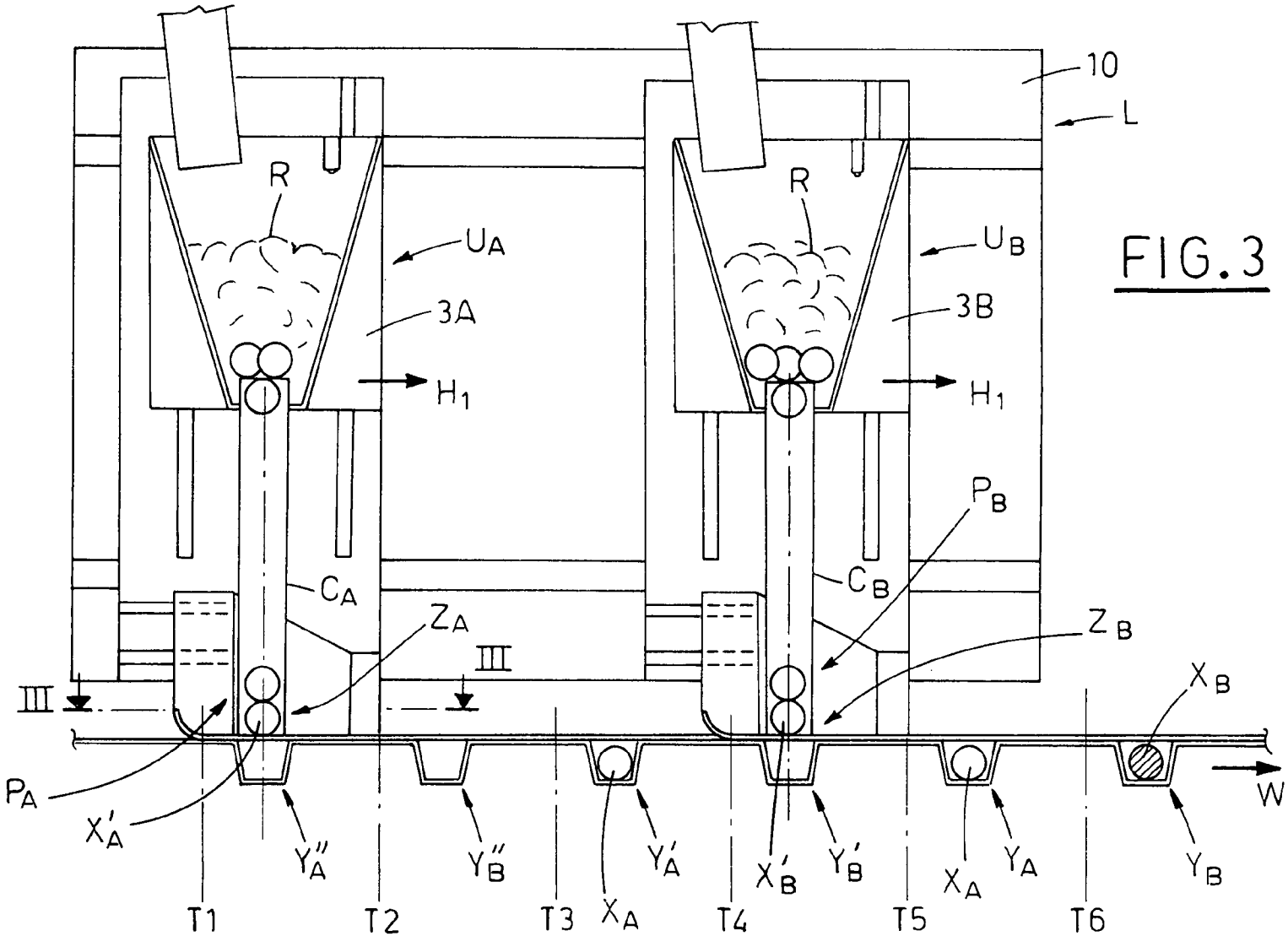
Figure 6:
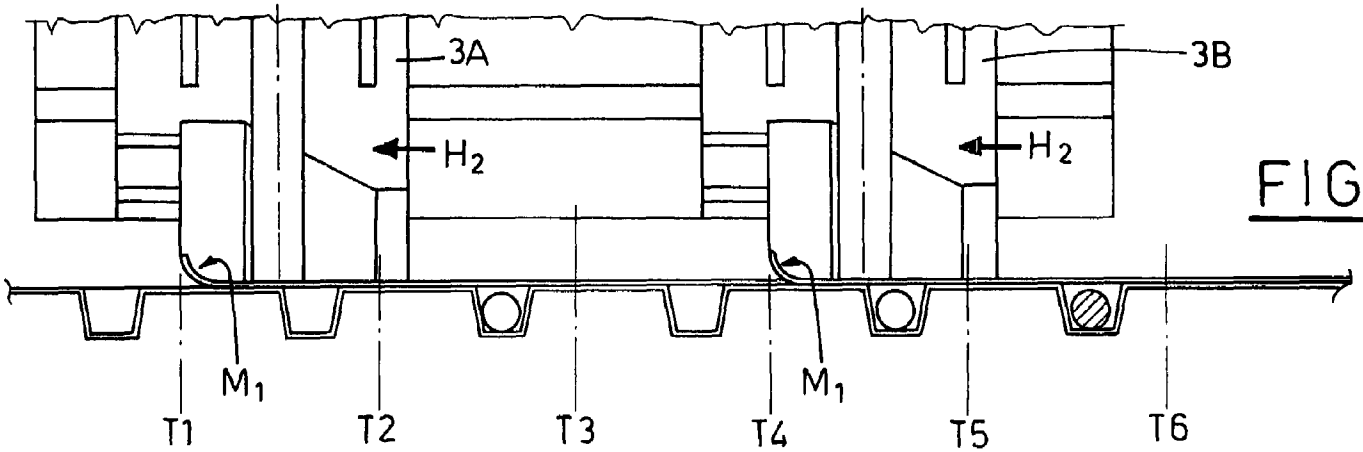
FIGS. 4, 5 and 6 show lateral and schematic views of the apparatus of the FIGS. 2 and 3 with some parts removed, in other significant working configurations.

The slides 3A, 3B are operated synchronously (direction H1) in such a way that, after the initial acceleration, the feeding conduits $C_A$, $C_B$ are coaxial and centered with respect to the blisters $Y''_A$, $Y'_B$: centering configuration of $Z_A$, $Z_B$ of FIG. 3.

Figure 3A:
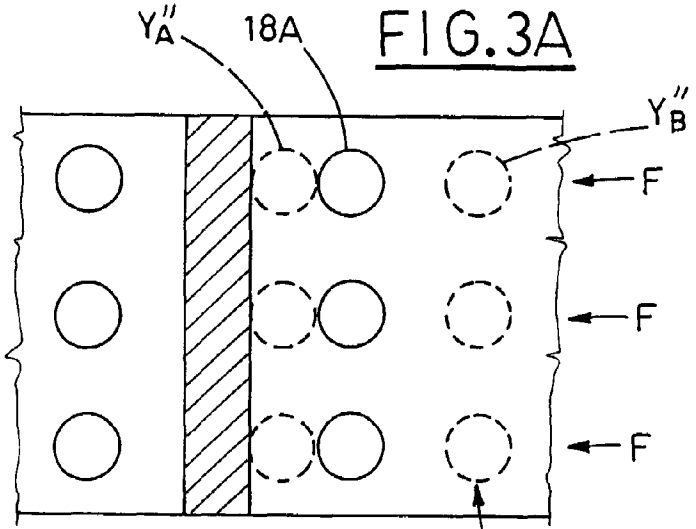

In the just described configuration, the lowermost product $X'_A$, $X'_B$ of each pile $P_A$, $P_B$ of products contained in the relative conduit $C_A$, $C_B$ is prevented from going down by the strips 17A, 17B, which act as shutters (see FIGS. 3, 3A).

Figure 4A:
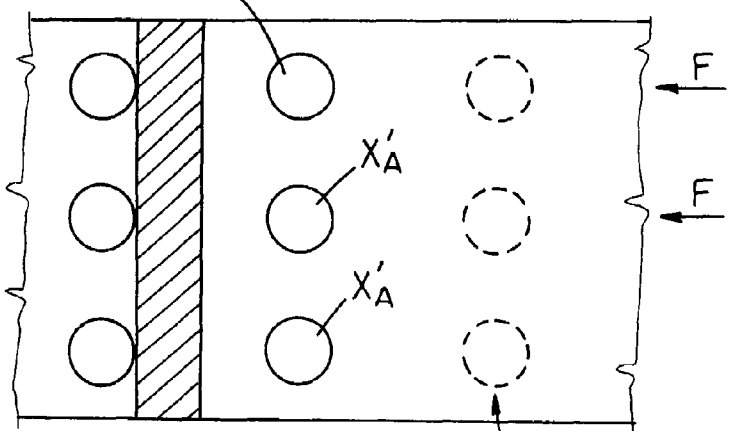
FIGS. 3A, 4A are schematic, top views taken according to markings III-III and IV-IV of FIGS. 3 and 4, respectively.
Figure 4:
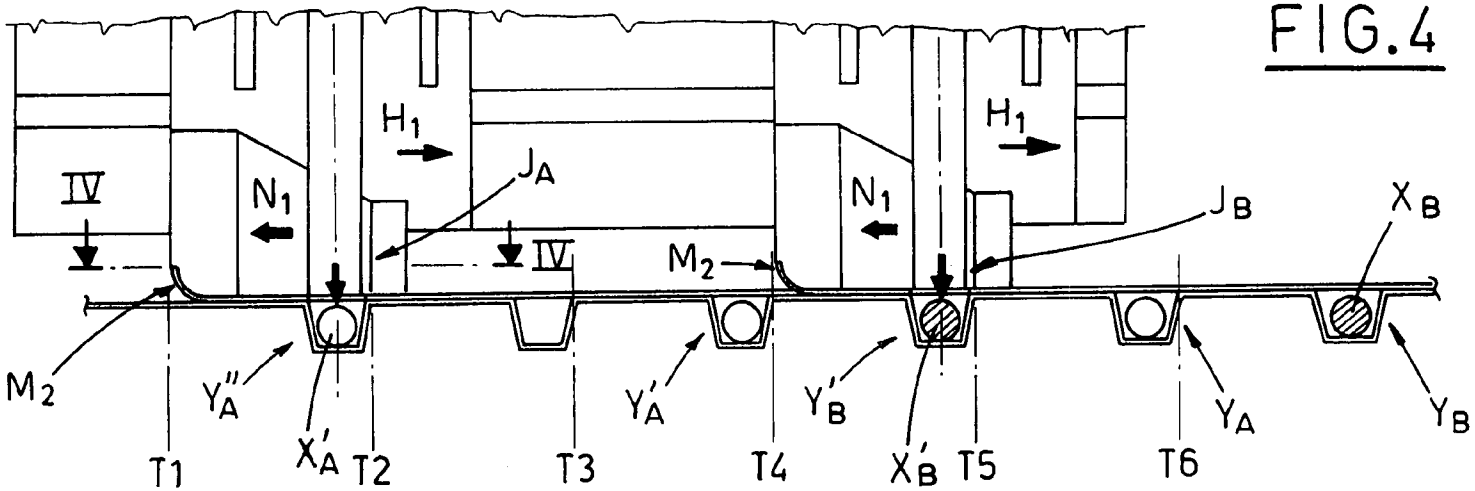
Figure 5:
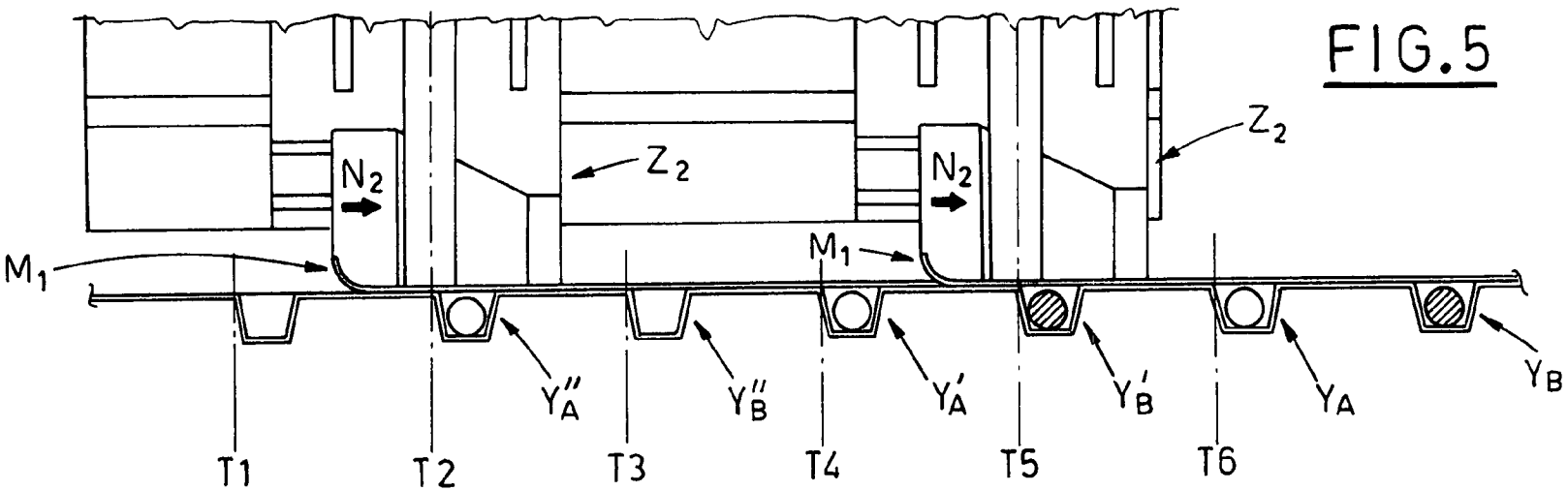

In step relation with the reaching of the centering configuration $Z_A$, $A_B$, the strips are moved (forward stroke N1), until they reach their operation position M2 (FIG. 4).

During this movement, the carriages 3A, 3B are operated with the same speed W as the blister band, so that the conduits CA, CB are kept motionless with respect to the blister band: this situation is maintained for a prefixed period of time.

When the strips 17A, 17B are in the operation position $M_2$, the holes 18A, 18B of the strips are coaxial and centered with respect to the lower ends I of the conduits $C_A$, $C_B$, situated above: this allows the lowermost products $X'_A$, $X'_B$, during the above time period, to enter, by falling, the relative blisters $Y''_A$, $Y'_B$—product feeding configuration $J_A$, $J_B$: see FIGS. 4, 4A.

In step relation with the occurrence of the above configuration, the moving assemblies 15A, 15B are moved (direction N2) to their non-operation position (FIG. 5) and the carriages 3A, 3B are operated, in step relation with the occurrence of their fore position $Z_2$ (FIG. 5), to define again the initial configuration of the carriages 3A, 3B and the moving assemblies 15A, 15B, shown in FIG. 2.

As it is known, after the blisters $Y_A$, $Y_B$ have been filled, the upper part of the band 20 is sealed.

The so called blister packs 100 are obtained from the assembly formed in this way, by cutting (see FIG. 7).

The blister pack, which has e.g. four transversal rows, contains two kinds of products, that is the first kind $X_A$ and the second kind $X_B$.

It is possible to obtain blister packs containing three kinds of products $X_A$, $X_B$, $X_C$, by using correspondingly three work units $U_A$, $U_B$, $U_C$, working in synchrony, as pointed out above.

The function of the strips 17A, 17B is double; they close the respective units, but they also cover the upper surface 20A of the band 20 in the loading area thereof: this way, the products are prevented from hopping about, which result in many advantages.

In the described example, each transversal row G of blisters 100 contains the products of the same kind.

It is possible to obtain a blister pack, in which the products of one transversal row are of different kinds.

This can be obtained with the number of holes 18 of the strip 17A of the first unit $U_A$ smaller than the number of blisters in one transversal row G of the blister band and the holes missing in the first strip are made instead in the strip 17B of the second unit $U_B$, and are obviously situated in such a way, as to complete the filling of the transversal row.

Otherwise, the just mentioned technical-functional aspect can be obtained by using a separating wall 50 in the hopper 9, to define two separate chambers fed with products $X_A$, $X_B$ by corresponding conduits 12 and feeding correspondingly a prefixed number of conduits C.

It is known that the blisters can be aligned in rows not perpendicular to the band forward motion direction W (FIG. 8A), or aligned crosswise in a staggered way (FIG. 8A).

The proposed technical solution allows to fill, with at least two kinds of products $X_A$, $X_B$, the blisters arranged in any way, for example FIGS. 8A, 8B.

The illustrated example takes into consideration two units $U_A$, $U_B$, moved synchronously.

Figure 9:
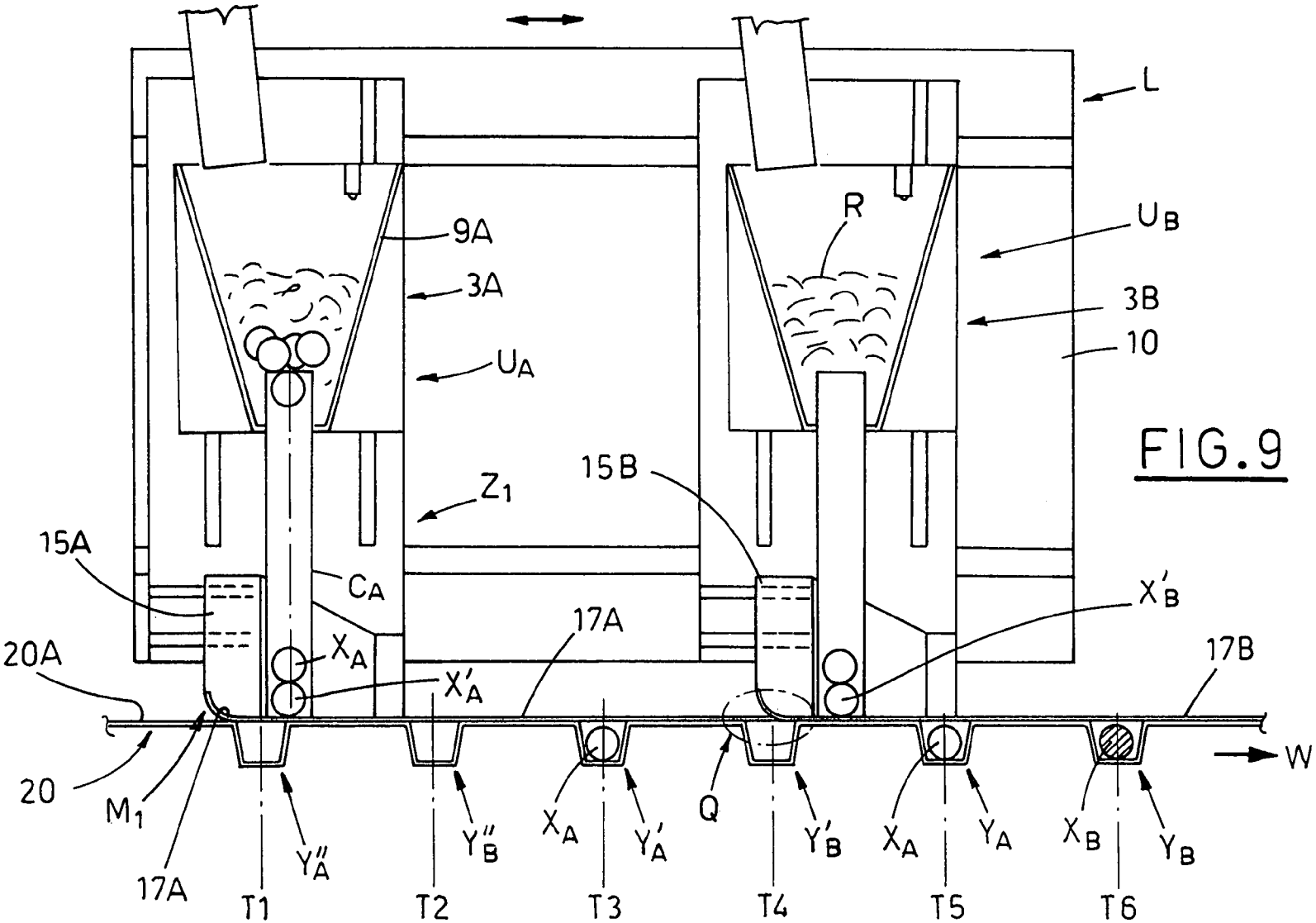
FIG. 9 is lateral and schematic view of a possible mutual position of two work units defining the present apparatus.

The two units can be operated independently, i.e. asynchronously; FIG. 9 shows the condition, in which the units are at the maximum mutual distance.

It is necessary to increase the length of the strip 17A of the first unit with respect to what has been shown in FIGS. 2-6 by a distance "Δ".

This allows to maintain the filling area of the band 20 always covered by the strips 17A, 17B (FIG. 9A).

Obviously, in this case, in the condition of minimum mutual distance between the units $U_A$, $U_B$, the strips are partially superimposed (FIG. 9B).

In order to remove damaged products from the band, or to perform cleaning and/or maintenance operations of the work units, it is necessary to raise the plate L, which must be done synchronously with the operation of the suction means of each arm 21, so as to facilitate also the raising of the strips 17A, 17B.

If the blistering machine, to which the present apparatus is connected, is stopped because one conduit C gets jammed, it is necessary to intervene on the means operating the hopper 9, so as to make it perform an additional stroke upwards, so that the ends S go above the level R and become accessible to the operator.

In case the band 20 is moved stepwise, it is sufficient to keep motionless the carriages 3A, 3B; all other operations remain unchanged.

The proposed apparatus fills the blisters of the blister band in a selective way, with one or more products, and the introduction of a first product $X_A$ into the respective blisters $Y_A$ does not influence, and is not influenced by the introduction of the second type of product $X_B$ into the corresponding blisters $Y_B$.

The herein recalled technical-functional feature can be carried out independently from the mutual arrangement of the blisters $Y_A$, $Y_B$ and from the distribution of different kinds of products inside the blisters.

The apparatus herein described and illustrated prevents the products already introduced in the band filling area from hopping, with all the resulting advantages.

The conformation of the apparatus allows a rapid operation on the band, in order to remove damaged products without blocking the band cleaning and/or maintenance operations.

The proposed apparatus can be advantageously used in blistering machines, in which the blister band is moved continuously.

The apparatus can be connected to blistering machines, in which the blister band is operated stepwise; in this case, the carriages 3A, 3B are kept motionless and their arrangement must be such, as to keep the respective conduits CA, CB centered with respect to the blisters $Y_A$, $Y_B$, when the blister band is in dwell situation.

What above, has been described as an example, the protective scope can be deduced from the following claims.

What is claimed is:

1. An apparatus for placing products into blisters of a blister band moved in a forward motion direction along a blistering machine, with blisters made in an upper surface of said blister band and made accessible from top, the apparatus having at least one work unit, situated above said blister band, the work unit including:

a carriage carried by a support, connected to a bearing structure of said blistering machine, with the carriage capable of sliding, with respect to the support, parallel to the blister band forward motion direction;

at least one hopper, carried by said carriage, fed with products and feeding said products to at least one discharge conduit fastened to said carriage, the discharge conduit having a lower end situated directly above the upper surface of said blister band and aligned with respect to a corresponding longitudinal row of blisters made in the latter;

first means for operating said carriage between two extreme positions, a rear position and a fore position, by a forward stroke and return stroke, with the forward stroke being operated in step relation with advancement of said blister band, so as to center the lower end of said discharge conduit with respect to a corresponding blister of said row, situated below and to maintain this centering for a prefixed period of time;

at least one moving assembly, connected to said carriage and carrying a strip interposed between said lower end of at least one discharge conduit and the upper surface of the blister band, and extending forward with respect to the band forward motion direction, said strip having at least one hole, which is aligned with the longitudinal row of blisters and whose size allows single products to pass therethrough;

second means for moving said strip parallel to the blister band forward motion direction, in step relation with the operation of said carriage, thus performing a forward stroke and a return stroke, between two extreme positions, a rest position and a working position, with the rest position preventing the lowermost product of the pile of products contained in said conduit from falling, and with the working position, defined by said forward stroke, allowing the centering of the hole with the lower end of said conduit, situated above, and consequently, allowing the said lowermost product to fall into said blister, during said time period.

2. An apparatus, as claimed in claim 1, further including at least two work units, provided with hoppers containing different kinds of products, which can be fed by means of respective discharge conduits to corresponding blisters of said blister band.

3. An apparatus, as claimed in claim 2, wherein the length of the strips of said work units is such as to cover longitudinally and continuously the filling area of said blister band.

4. An apparatus, as claimed in claim 2, wherein the carriages of said work units are moved in synchrony.

5. An apparatus, as claimed in claim 3, wherein the carriages of said work units are moved in synchrony and said strips are also moved in synchrony.

6. An apparatus, as claimed in claim 2, wherein the carriages of said work units are moved asynchronously.

7. An apparatus, as claimed in claim 3, wherein the carriages of said work units are moved asynchronously and said strips are moved asynchronously.

8. An apparatus, as claimed in claim 1, wherein said strip matches with the upper surface of said blister band.

9. An apparatus, as claimed in claim 3, wherein said strips match with the upper surface of said blister band.

10. An apparatus, as claimed in claim 1, wherein the hopper of said at least one work unit includes at least two separate chambers fed with different products and feeding these products to corresponding discharge conduits.

11. An apparatus, as claimed in claim 1, wherein the moving assembly carrying said strip also carries a first arm, with an upstream end of the strip fastened to said arm.

12. An apparatus, as claimed in claim 11, wherein said moving assembly supports a second arm, situated downstream of the first arm, with respect to the blister band forward motion direction, and having suction means for raising, when operated, the strip below when the work unit in cleaning and/or maintenance configuration.

13. An apparatus, as claimed in claim 3, wherein the length of said strips is such, as to cause partial superimposing of the strips, at least in a configuration of minimum mutual distance between the respective units.

14. An apparatus, as claimed in claim 1, wherein the support of each of said units moves vertically, for raising the respective unit with respect to the blister band, when the unit is inoperative.

15. An apparatus, as claimed in claim 1, wherein said hopper slides vertically with respect to the carriage and that said discharge conduit, fastened to the carriage, is freely introduced into a hole made in the bottom of the hopper, with means being provided for operating the hopper to move vertically with a vibratory motion, so as to allow the products contained therein to be enter to the discharge conduit.

16. An apparatus, as claimed in claim 1, wherein the fore stroke of said moving assembly is discordant with respect to the blister band forward motion direction.

17. An apparatus, as claimed in claim 2, wherein said units are carried by only one support.

18. An apparatus, as claimed in claim 1, wherein said moving assembly is carried, sliding, by guides made in the carriage, parallel to the band forward motion direction.

* * * * *